US005950307A

United States Patent [19]

Lee

[11] Patent Number: 5,950,307

[45] Date of Patent: Sep. 14, 1999

[54] METHOD OF ATTACHING A CAPILLARY TUBE TO A MUFFLER OF A RECIPROCATING COMPRESSOR

[75] Inventor: Sung-Tae Lee, Suwon, Rep. of Korea

[73] Assignee: Samsung Electronics Co., Ltd., Suwon, Rep. of Korea

[21] Appl. No.: 08/970,562

[22] Filed: Nov. 14, 1997

Related U.S. Application Data

[62] Division of application No. 08/612,462, Mar. 7, 1996, Pat. No. 5,762,478.

[30] Foreign Application Priority Data

Mar. 7, 1995 [KR] Rep. of Korea ..... 95-4633

[51] Int. Cl.[6] ..... B23D 15/00

[52] U.S. Cl. ..... 29/888.02; 29/888

[58] Field of Search ..... 29/888.02, 888, 29/428; 417/312, 540

[56] References Cited

U.S. PATENT DOCUMENTS 4,759,693 7/1988 Outzen ..... 417/312

5,118,263 6/1992 Fritchman ..... 417/415

*Primary Examiner*—Irene Cuda

*Attorney, Agent, or Firm*—Burns, Doane, Swecker & Mathis, L.L.P.

[57] ABSTRACT

A reciprocating compressor includes a cylindrical bore in which a piston reciprocates. A cylinder head is situated adjacent an end of the bore and forms a suction chamber and a discharge chamber which communicate with the bore through respective valved passages. Fluid to be compressed enters the suction chamber through an outlet section of a muffler. That outlet section is made of a material having low thermal conductivity (plastic) and fits into the suction chamber to resist the transfer of heat to the suction chamber from the discharge chamber. A capillary tube includes an inlet end submerged in an oil reservoir and an outlet end mounted in a hole formed in the outlet section of the muffler for supplying oil to fluid entering the bore.

3 Claims, 6 Drawing Sheets

METHOD OF ATTACHING A CAPILLARY TUBE TO A MUFFLER OF A RECIPROCATING COMPRESSOR

This application is a divisional of application No. 08/612,462, filed Mar. 7, 1996, now U.S. Pat. No. 5,762,478.

BACKGROUND OF THE INVENTION

Field of the Invention

The present invention relates to a method of attaching a capillary tube to a muffler of a reciprocating compressor for use in a heat-cooling apparatus.

Generally, a compressor according to the prior art includes, as illustrated in FIG. 1, an air-tight body 10, a stator 12 disposed within the body 10 to form a magnetic field, a rotor 14 for being rotated by the magnetic field formed by the stator 12, a rotary axle 18 for being rotated in cooperation with the rotor 14 and attached to an eccentric axle 16 eccentrically formed at one end thereof, a connecting rod 20 for converting rotary movement of the rotary axis 18 to reciprocating motion, a piston 22 attached to the connecting rod 20 to thereby perform a reciprocating motion, and a cylinder apparatus 31 for guiding the piston 22 for compressing the refrigerant.

A support bearing 62 is provided at an upper side thereof with a washer 64 for expediting smooth rotation of the rotor 14.

The cylinder apparatus 31 includes a cylinder block 26 in which the piston 22 performs the reciprocating motion to compress the refrigerant, and an assemblage of gaskets 51 and 59 disposed on opposite sides of a conventional valve plate 57 which forms valved inlet and outlet passages for conducting refrigerant into and from the cylindrical bore. A cylinder head 52 is disposed at an external side of the gasket 59 and is partitioned into a suction chamber 521 and a discharge charge 522.

The cylinder apparatus is provided at an upper side thereof with a muffler 40 for reducing the noise and the like originated from the refrigerant infused through a suction pipe 56.

The suction chamber 521 is formed at one end thereof with a capillary tube 63 fixedly welded to a plug 55, as illustrated in FIG. 2A, in order to suck and supply to the cylinder apparatus 31 oil stored in an oil chamber 65 formed at a bottom surface of the body 10.

In the compressor thus constructed according to the prior art, when electric power is applied to the stator 12, a magnetic field is formed and the rotor 14 is rotated by the magnetic field.

When the rotary axle 18 is rotated by rotation of the rotor 14, the piston 22 reciprocates, thereby compressing the refrigerant within the cylinder block 26.

Meanwhile, an oil pick-up member 66 attached to a lower side of the rotary axle 18 serves to guide and raise up along a groove 18*a* the oil stored in the oil chamber 65 according to rotary movement of the rotary axle 18, and the raised oil is discharged through an oil discharge groove (not shown) formed in the support bearing 62, to thereby lubricate a washer 64 and then drop back into the oil chamber 65.

The capillary tube 63 serves to conduct suction to the oil stored in the oil chamber 65 and suck the oil into the suction chamber 521 of the cylinder head 52, so that the suction valve 53 and the piston 22 can be cooled and an oil film can be formed thereon. The piston performing the reciprocating motion within the cylinder block 26 serves to maintain the pressure in the cylinder block 26 at an almost vacuum state, to suck-in the refrigerant.

However, there is a problem in the compressor thus constructed according to the prior art, in that the cylinder head 52 becomes heated when the refrigerant of high pressure and high temperature compressed within the cylinder block 26 is infused into the discharge chamber 522 through the suction valve 53. Thus when uncompressed refrigerant passes through the heated cylinder head 52 en route to the cylinder head, the refrigerant becomes heated, thereby reducing the compression efficiency of the compressor.

There is another problem in that an increase in manufacturing cost is involved due to increased manufacturing steps for assembling the capillary tube 63 into a cutting-processed cylinder head 52 by way of indenting because the plug 55 and the capillary tube 63 must be integrally assembled therebetween by welding or the like.

SUMMARY OF THE INVENTION

The present invention has been disclosed to solve the aforementioned problems.

It is an object of the present invention to provide a method for attaching a capillary tube to a reciprocating compressor by which the manufacturing process can be simplified to thereby reduce manufacturing cost involved in attaching a capillary tube to a cylinder head.

In accordance with the present invention, there is provided method of attaching a capillary tube to a reciprocating compressor, the method comprising the steps of:

pushing a portion of the capillary tube into a groove formed in the cylinder head, the capillary tube submerged in an oil chamber;

inserting horizontally a bent portion of the capillary tube into a hole of the muffler base while the capillary tube is fixed to the cylinder head by way of a resilient force of the bent portion;

fixing a muffler base fixing unit formed beneath the muffler base to the cylinder head, fixing a muffler base guide formed at the muffler base to the cylinder head and fixing the muffler base guide formed in the muffler base to a lateral side of the suction chamber formed in the cylinder head; and fastening the cylinder head employed by the muffler base to the cylinder block by way of a plurality of fastening means.

BRIEF DESCRIPTION OF THE DRAWINGS

For a more complete understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
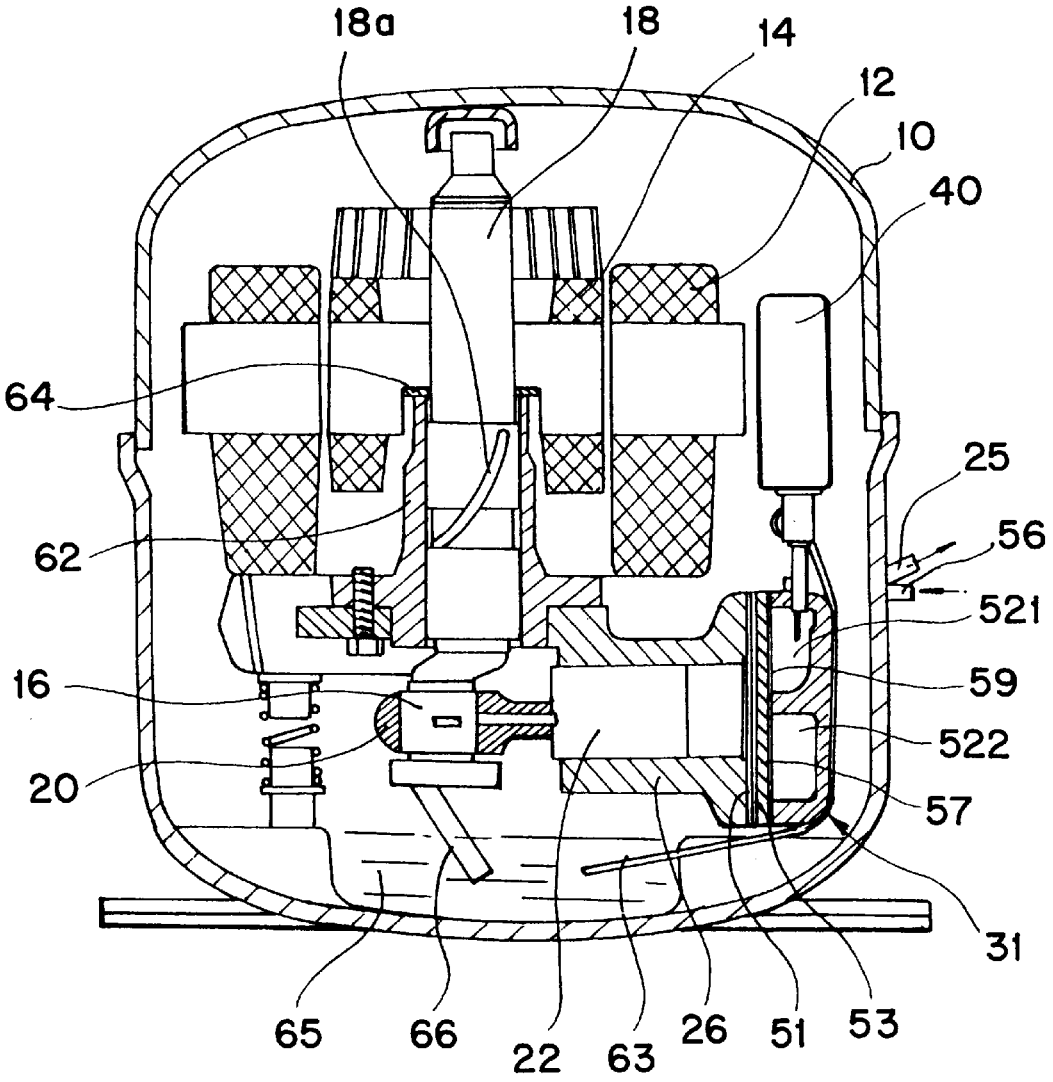
FIG. 1 (PRIOR ART)
FIG. 1 is a schematical diagram for illustrating a sectional view of a compressor according to the prior art.
Figure 2B:
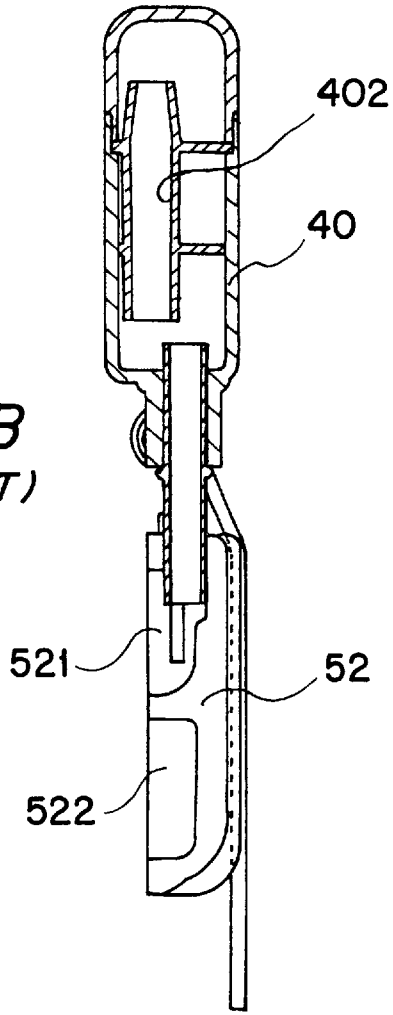
FIG. 2B (PRIOR ART)
FIG. 2A is a plan view for illustrating a cylinder apparatus according to the prior art and FIG. 2B is a sectional view for illustrating a cylinder apparatus according to the prior art.
Figure 2A:
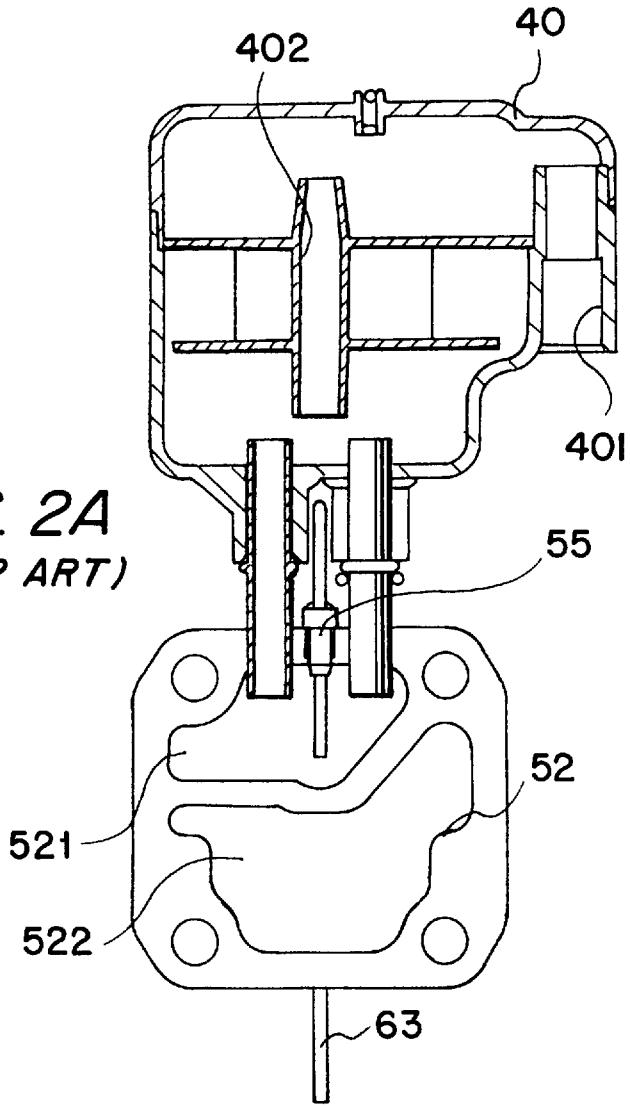
FIG. 2A (PRIOR ART)

Now, the embodiment of the present invention will be described in detail with reference to the accompanying drawings.

Throughout the drawings, like reference numerals are used for the designation of like or equivalent parts or portions for simplicity of illustration and explanation.

Figure 3:
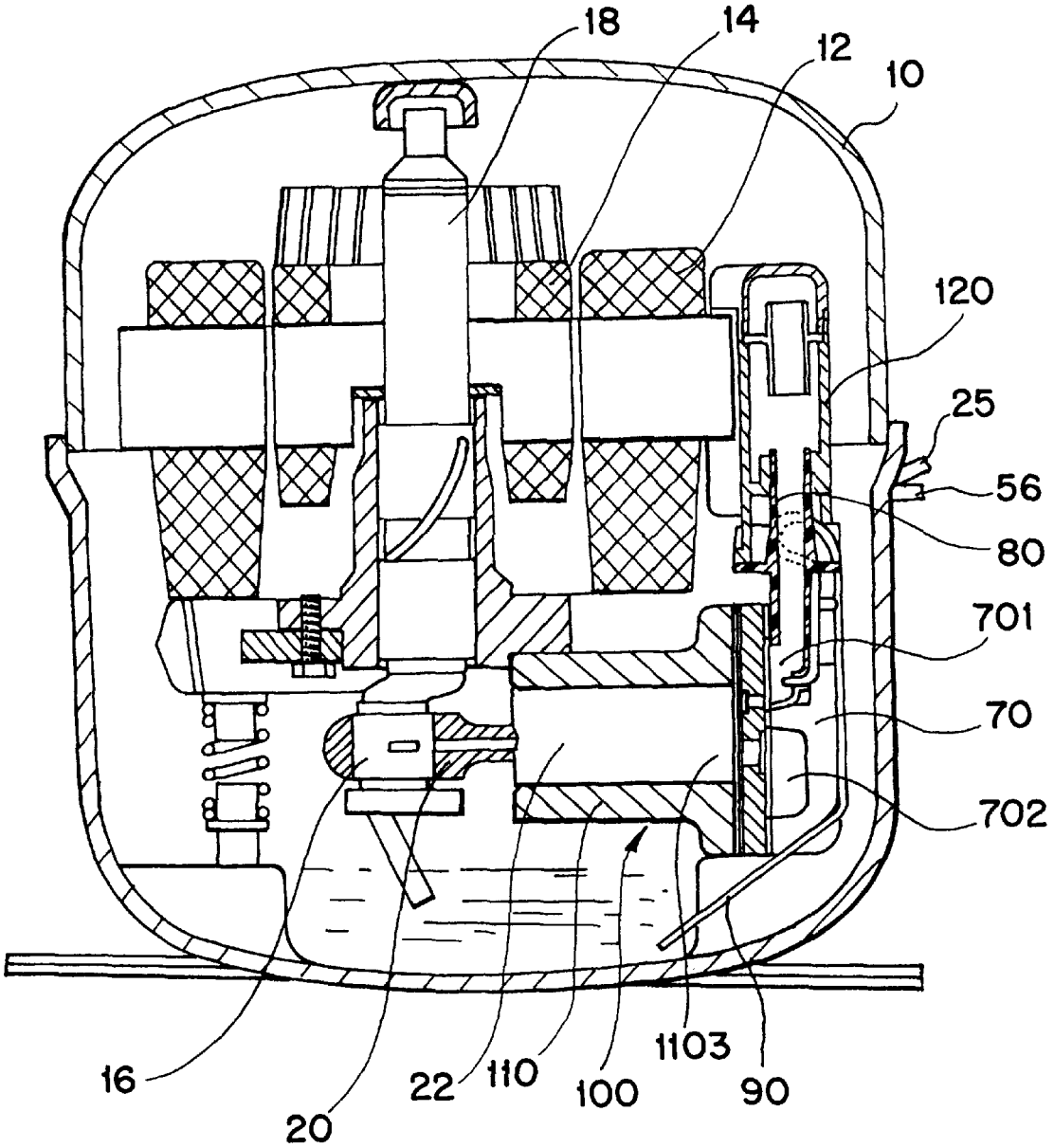
FIG. 3 is a sectional view for illustrating a compressor according to the present invention.

FIG. 3 is a sectional view for illustrating a compressor according to the present invention, where the compressor includes a stator 12 disposed within a body 10 to form a magnetic field, a rotor 14 for being rotated by the magnetic field formed by the stator 12, a rotary axle 18 for being rotated in cooperation with the rotor 14 and attached an eccentric axle 16 eccentrically formed at one end thereof, a connecting rod 20 for converting rotary movement of the rotary axis 18 to reciprocating motion, a piston 22 attached to the connecting rod 20 to thereby perform a reciprocating motion in a cylindrical bore 1103 , a cylinder apparatus 100 for compressing the refrigerant infused through a suction pipe 56 to thereby discharge the same to a discharge pipe 25, and a capillary tube 90 disposed on the cylinder apparatus 100 to suck-up oil.

Figure 4:
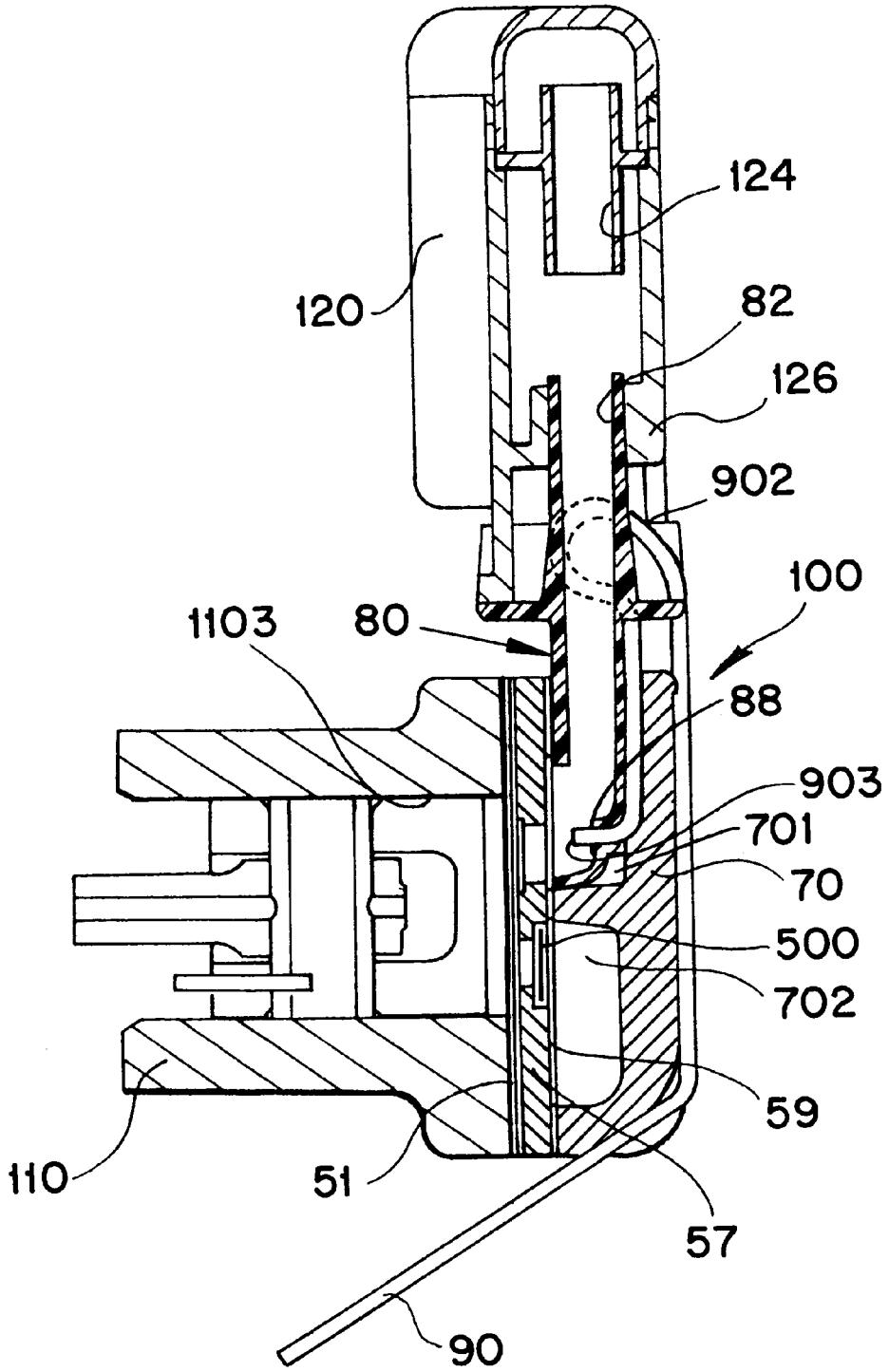
FIG. 4 is a sectional view for illustrating a cylinder apparatus according to the present invention.

The cylinder apparatus 100 is, as illustrated in FIG. 4, provided at one side thereof with an assemblage of gaskets 51 and 59 disposed on opposite sides of a conventional valve plate 67 which forms valved inlet and outlet passages for conducting refrigerant into and from the cylindrical bore 1103.

Figure 5:
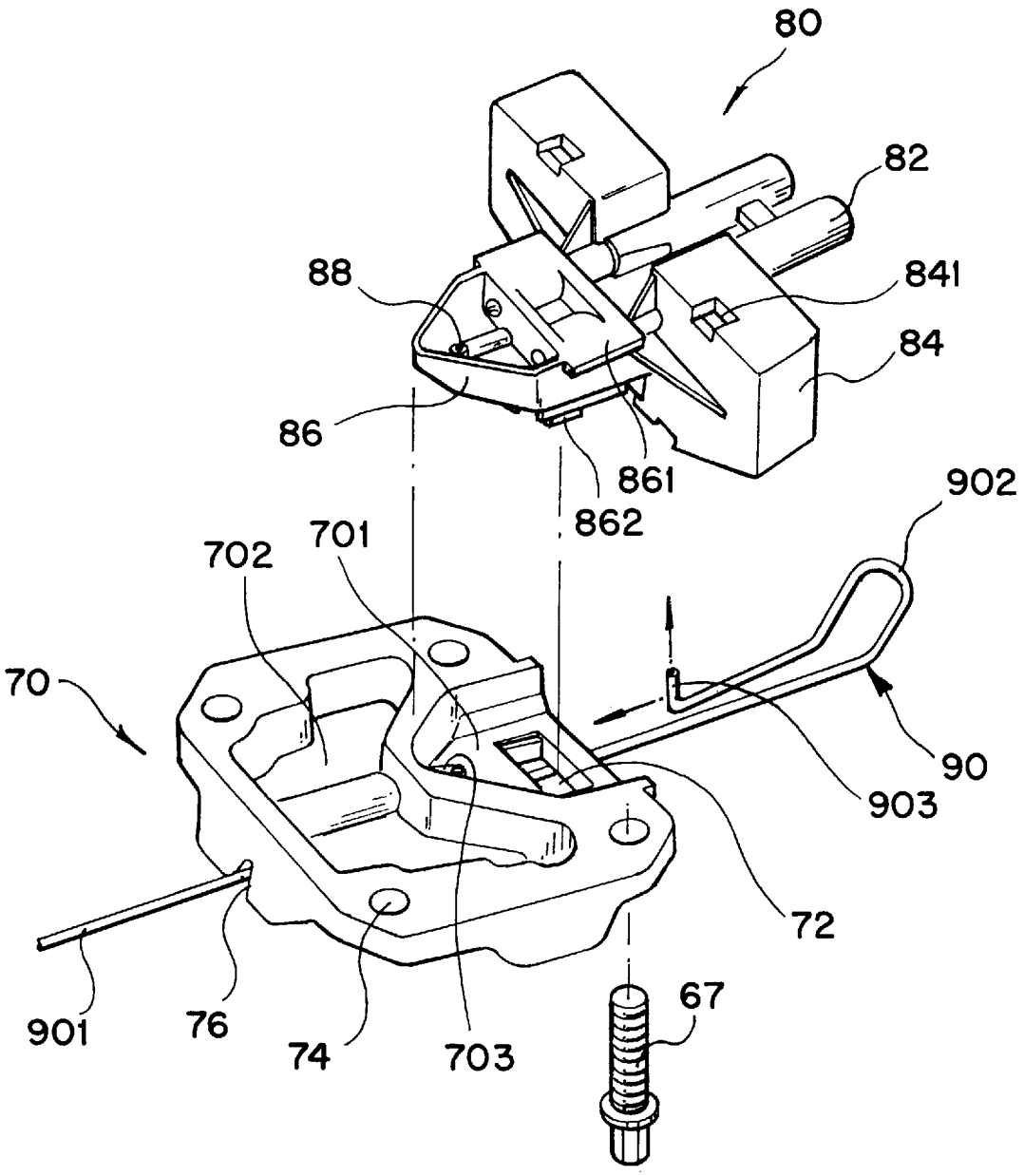
FIG. 5 is an exploded perspective view for illustrating a cylinder apparatus according to the present invention.

The gasket 59 is engaged at an external side thereof by a cylinder head 70 which is partitioned into a suction chamber 701 and a discharge chamber 702 and is fixed to the cylinder block 110 by a plurality of fastening means 57 (see FIG. 5).

The cylinder head 70 is, as illustrated in FIGS. 3 and 4, attached at an upper side thereof to a muffler 120 for reducing the noise and like generated from the refrigerant infused through the suction pipe 56, and the muffler 120 is provided at one side thereof with a muffler base or outlet section 80, formed of plastic, for guiding the refrigerant into the cylinder head 70.

Meanwhile, the cylinder head is centrally provided with the cylindrical bore 1103 (see FIG. 4) so that the refrigerant sucked from external can be compressed according to reciprocating motion of the piston 22.

The cylindrical bore 1103 communicates at one side thereof with a discharge hole (not shown in FIG. 4) for discharging the compressed refrigerant into the discharge chamber 702.

The cylinder head 70 is, as illustrated in FIG. 5, formed at a rear surface thereof with a groove 76 for receiving the capillary tube 90 and, at a periphery thereof, with a plurality of through holes 74 so as to be fixed to the cylinder block 110 by a plurality of fastening means 67.

Furthermore, the suction chamber 701 is formed with a recess 72 for receiving a projection 862 of the muffler base 80.

The suction chamber 701 is provided at a lower side thereof with a groove 703 for receiving and stabilizing a portion of the capillary tube 90.

The discharge chamber 702 enables refrigerant compressed within the cylinder block 110 to be discharged outside through the discharge pipe 25.

Figure 6B:
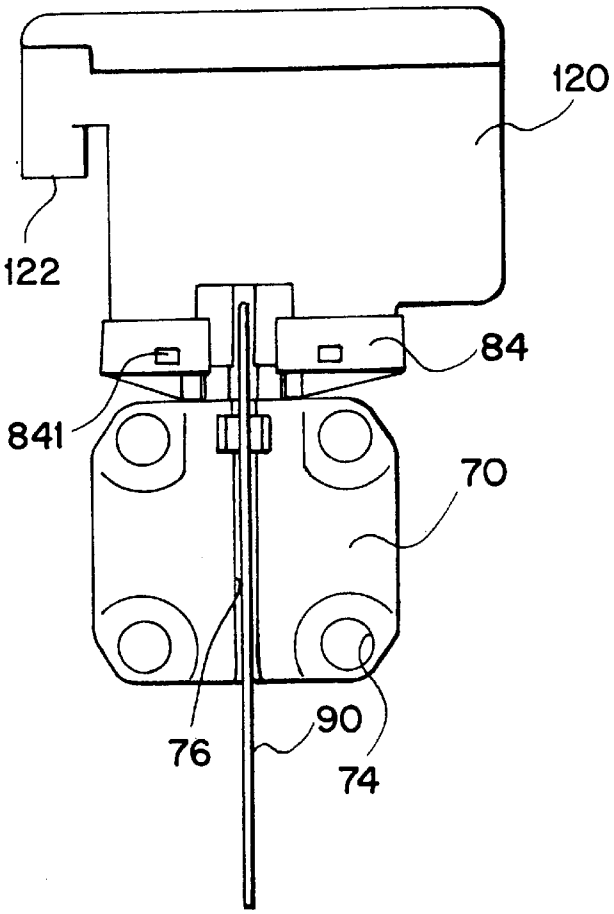
FIG. 6A is a plan view for illustrating a cylinder apparatus according to the present invention and FIG. 6B is a rear elevation for illustrating a cylinder apparatus according to the present invention.
Figure 6A:
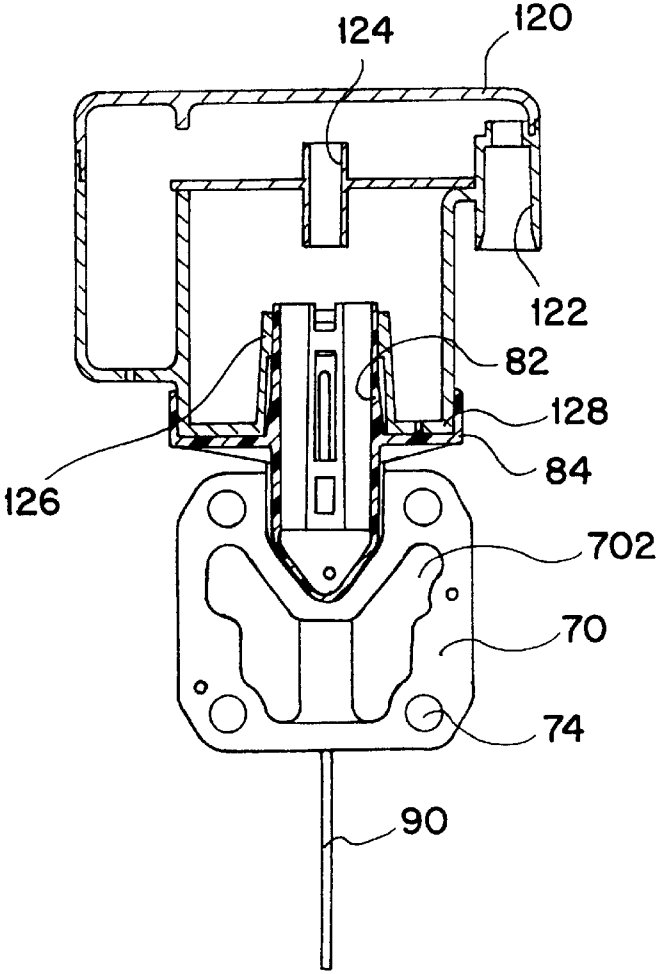

The muffler 120 is provided at one side thereof, as illustrated in FIGS. 6A and 6B, with a suction hole 122 for conducting incoming refrigerant and is provided with a guide hole 124 for guiding the refrigerant from the suction hole 122 to the muffler base 80.

The muffler 120 is provided at a lower side thereof with a fixation unit 126 for being fixed to the muffler base 80, and the fixation unit 126 is internally formed with a support unit 128 for tightly fixing the muffler base 80 thereto.

The muffler base 80 includes, as illustrated in FIG. 5, (i) a pair of fastening tubes 82 having a predetermined elastic force and attached to the muffler 120, (ii) a muffler base fixation unit 84 formed at an upper portion thereof with a fastening hole 841 so as to be connected at one side surface thereof to the fastening members 82 and to be fixed to the muffler 120, (iii) a muffler base head 86 of V-shape, (iv) a muffler base guide 861 connected to the muffler base head 86 to prevent the temperature thereof from rising as the result of the entry of refrigerant of high temperature and high pressure into the discharge chamber 702 and (v) a muffler base fixing unit 862 which forms the projection to be inserted into the recess 72 of the suction chamber.

The capillary tube 90 includes, as illustrated in FIG. 5, a bent or folded portion 902 which defines an elastic region, and a bent end 903 being bent in generally the same direction as the bent portion 902 to be inserted into an insertion hole 88 formed in the muffler base 80.

Meanwhile, a method of attaching the capillary tube to the reciprocating compressor according to the present invention will be described in conjunction with FIG. 5.

The attachment method comprises the steps of:

A) pushing into the groove 76 formed in the cylinder head 70 a lower section 901 of the capillary tube 90 whereby the lower end of the tube is submerged in oil chamber 65;

B) inserting the bent end 903 of the capillary tube 90 into the hole 88 of the muffler base while the capillary tube 90 is retained on the cylinder head 70 by way of a resilient force of the bent portion 902;

C) fixing the muffler base fixing unit 862 in the recess 72, and fixing the muffler base guide 861 to a lateral side of the suction chamber 701; and D) fastening the cylinder head 70 to the cylinder block 110 by way of fastening means 67.

The foregoing description according to the present invention is not to be taken as limiting to FIGS. 3, 4, 5 and 6. Many modifications and variations are possible in light of the above teaching. By way of example, it should be noted that the severity of the bend of the bent portion 902 of the capillary tube 90 for providing an elastic region can be changed, or the suction chamber 701 formed at the cylinder head 70 can be modified in shape thereof to a rectangle, a half moon, a multi-angled style or the like.

Now, the operation of the present invention according to the preferred embodiment thus constructed will be described.

When electric power is applied to the stator 12 of the compressor, a magnetic field is formed by the stator 12 which rotates the rotor 14 and the eccentric axle 16.

The connecting rod 20 serves to convert rotary movement of the rotary axle 18 to a reciprocating motion to reciprocate the piston 22 so that the refrigerant sucked into the cylinder block 110 is compressed.

The refrigerant which has entered the suction pipe 56 is infused into the suction hole 122 and the guide hole 124 formed within the muffler 120.

The refrigerant that has passed the guide hole 124 is introduced into the suction chamber 701 through the pair of fastening tubes 82.

The refrigerant in the suction chamber 701 flows into the cylindrical bore 1103 through the gasket 59, valve plate 57, suction valve 53 and another gasket 51.

The refrigerant sucked into the cylinder block 110 is compressed to high temperature and high pressure by the piston 22 reciprocating in the cylinder block 110 and is thereafter discharged into the discharge chamber 702 through the gasket 51, valve plate 57, discharge valve 500 and the gasket 59.

The compressor has been markedly improved in efficiency by reducing the thermal conduction of high temperature from the discharge chamber 702 into the suction chamber 701, because the muffler base 80 coupled to the suction chamber 701 is made of plastic material having a low thermal conductivity. Thus, the temperature in the suction chamber 701 cannot be increased to a high level due a to heat transfer from high-temperature refrigerant when the refrigerant enters the discharge chamber 702.

Therefore, the refrigerant that has passed the discharge chamber 702 formed in the cylinder head 70 is collected at a discharge space (not shown) disposed in the cylinder block 110 and is discharged via the discharge pipe 25.

As is apparent from the foregoing, the method of attaching a capillary tube to a reciprocating compressor, according to the present invention, are advantageous in several respects such as providing improved efficiency of the compressor and easy assemblage of the capillary tube, because the muffler base prevents the temperature in the suction chamber from rising, and an insertion hole is formed in the muffler base in order to facilitate an easy assemblage of the capillary tube to the cylinder head.

The foregoing description of the preferred embodiment has been presented for the purpose of illustration and description. It is not intended to limit the scope of this invention. Many modifications and variations are possible in light of the above teaching. It should be noted that the present invention can be applied to all kinds of the apparatus within the scope of the above presentation.

What is claimed is:

1. A method of attaching a capillary tube to a reciprocating compressor; the compressor including a block having a cylindrical bore in which a piston is reciprocably mounted, a cylinder head forming a suction chamber and a discharge chamber, both chambers communicating with the cylindrical bore, the suction chamber supplying fluid to the bore, and the discharge chamber receiving compressed fluid discharged from the bore; a side of the cylinder head facing away from the bore including a groove; a muffler including an outlet section for conducting fluid to the suction chamber, a portion of the outlet section being disposed in the suction chamber and including a hole; a resilient capillary tube having inlet and outlet ends, and a generally U-shaped bent portion disposed between the inlet and outlet ends; the method comprising the steps of:

A) pressing the capillary tube into the groove so that the inlet end of the tube is emersed in lubricating oil;

B) positioning the bent portion of the capillary tube around a portion of the muffler outlet section and inserting the outlet end of the capillary tube into the hole of the muffler outlet section while the capillary tube is retained in place by a resilient force of the bent portion;

C) positioning the muffler outlet section within the suction chamber; and

D) mounting the cylinder head to the block.

2. The method according to claim 1 wherein during steps B and C the outlet end of the capillary end is biased into the hole by the resilient force of the bent portion.

3. The method according to claim 1 wherein step C includes positioning a portion of the capillary tube between the muffler outlet section and a wall of the cylinder head.

* * * * *